US008905952B2

(12) United States Patent
Berthiaume

(10) Patent No.: US 8,905,952 B2
(45) Date of Patent: Dec. 9, 2014

(54) SIMPLE PORTABLE LUMBAR SPINE DISTRACTION DEVICE AND METHOD

(76) Inventor: Roland F. Berthiaume, Springfield, MA (US)

( * ) Notice: Subject to any disclaimer, the term of this patent is extended or adjusted under 35 U.S.C. 154(b) by 575 days.

(21) Appl. No.: 12/803,366

(22) Filed: Jun. 25, 2010

(65) Prior Publication Data

US 2011/0319934 A1 Dec. 29, 2011

(51) Int. Cl.
*A61H 1/02* (2006.01)

(52) U.S. Cl.
CPC ..... *A61H 1/0292* (2013.01); *A61H 1/0218* (2013.01); *A61H 2201/1269* (2013.01); *A61H 2201/1642* (2013.01); *A61H 2203/0456* (2013.01)
USPC ..... 601/135; 601/23; 601/134; 602/32

(58) Field of Classification Search
USPC ..... 601/134, 135, 33–35; 606/237; 602/36, 602/32–34; 482/121, 125, 126, 140, 907
See application file for complete search history.

(56) References Cited

U.S. PATENT DOCUMENTS

| | | | | | |
|---|---|---|---|---|---|
| 3,672,361 | A | * | 6/1972 | Fourneron | 606/241 |
| 3,800,787 | A | * | 4/1974 | Rush | 602/34 |
| 3,827,429 | A | | 8/1974 | Heikes | |
| 4,362,151 | A | | 12/1982 | Cottrell | |
| 4,489,713 | A | * | 12/1984 | Latenser | 606/242 |
| 4,566,693 | A | * | 1/1986 | Seidentop et al. | 482/144 |
| 4,627,423 | A | | 12/1986 | Kampner | |
| 4,664,101 | A | * | 5/1987 | Granberg | 602/33 |
| D292,427 | S | * | 10/1987 | Baburek | D21/692 |
| 4,890,606 | A | | 1/1990 | Iams | |
| 5,042,214 | A | | 8/1991 | Howard | |
| 5,046,726 | A | * | 9/1991 | Van Straaten | 482/125 |
| 5,135,459 | A | * | 8/1992 | Perry, Jr. | 482/144 |
| 5,154,685 | A | * | 10/1992 | Chen | 482/126 |
| 5,232,425 | A | * | 8/1993 | Miller et al. | 482/121 |
| 5,295,936 | A | * | 3/1994 | Perry, Jr. | 482/144 |
| D368,562 | S | * | 4/1996 | Sterling | D32/59 |
| 5,695,436 | A | * | 12/1997 | Huang | 482/121 |
| 5,759,138 | A | * | 6/1998 | Boland | 482/122 |
| 5,820,520 | A | * | 10/1998 | Sieber | 482/34 |
| 5,964,685 | A | * | 10/1999 | Boland | 482/122 |
| 6,007,507 | A | | 12/1999 | Leoany | |
| 6,056,676 | A | * | 5/2000 | Adams | 482/112 |
| 6,113,564 | A | * | 9/2000 | McGuire | 602/32 |
| 6,203,473 | B1 | * | 3/2001 | Atwood | 482/95 |

(Continued)

*Primary Examiner* — Justine Yu
*Assistant Examiner* — LaToya M Louis
(74) *Attorney, Agent, or Firm* — Burns & Levinson LLP; Jacob N. Erlich; Marlo Schepper Grolnic

(57) ABSTRACT

A simple, lightweight, portable, lumbar spinal distraction device is provided which employs a frame having concave left and right hand upper leg contacting members for asserting forces against substantially vertically oriented left and right upper leg portions of a user assuming a substantially horizontal position. The user pushes the portable frame forward by manually grasping a pair of handles, causing the left and right contacting members to press against the vertically oriented left and right upper leg portions respectively. Increased unilateral traction ability is produced by simply having the user apply extra force to one handle or the other. This will permit users suffering from unilateral pain in the buttocks, hip or leg to obtain a little extra pressure on the symptomatic side. Anyone who has suffered low back pain can relate to the fact that some days the pain feels more right sided and some days more left sided.

3 Claims, 2 Drawing Sheets

(56) References Cited

U.S. PATENT DOCUMENTS

| | | | | |
|---|---|---|---|---|
| 6,302,859 | B1 * | 10/2001 | Cushman | 602/32 |
| 6,428,496 | B1 * | 8/2002 | Sargent | 602/32 |
| 6,626,808 | B1 * | 9/2003 | Adams | 482/140 |
| 6,770,013 | B2 * | 8/2004 | Stillinger | 482/91 |
| 6,776,767 | B2 | 8/2004 | Reinecke | |
| 6,939,269 | B2 * | 9/2005 | Makofsky | 482/10 |
| 6,939,277 | B2 * | 9/2005 | Tuller et al. | 482/140 |
| 6,971,392 | B2 * | 12/2005 | Lindahn et al. | 128/882 |
| 6,986,181 | B2 * | 1/2006 | Murphy et al. | 5/648 |
| 6,994,683 | B1 * | 2/2006 | Starr | 602/32 |
| 7,108,671 | B2 | 9/2006 | Saunders | |
| 7,267,640 | B2 * | 9/2007 | Patton | 482/91 |
| 7,569,003 | B1 * | 8/2009 | Huffman | 482/112 |
| 2007/0099778 | A1 * | 5/2007 | Ko | 482/146 |
| 2007/0161480 | A1 * | 7/2007 | Trancart et al. | 482/907 |
| 2009/0280970 | A1 * | 11/2009 | Anderson | 482/140 |

* cited by examiner

SIMPLE PORTABLE LUMBAR SPINE DISTRACTION DEVICE AND METHOD

BACKGROUND OF THE INVENTION

The applicant, who is a practicing chiropractor, has suffered back pain all his life and during his college days he learned that he has an abnormally shaped vertebra that causes premature disc degeneration. He has determined that there is a need for a lightweight portable spinal distraction device that enables a user to carry the device from place to place and used virtually anywhere. This is in contrast with complex costly devices in use that often require visits to a medical facility that provides such complex devices to patients. His goal was to invent a device that can be self-administered by a user at home and could function better and more comfortably than any devices that I have seen on the market that involve the use of weights, inversion, or being tied down or being clamped about the ankles.

Furthermore, a simple portable spinal distraction device that is easy to use could be made widely available due to its low manufacturing cost.

BRIEF SUMMARY OF PREFERRED EMBODIMENTS OF THE INVENTION

A lightweight, portable, lumbar spinal distraction device is provided which employs a frame having concave left and right hand upper leg contacting members for asserting forces against substantially vertically oriented left and right upper leg portions of a user assuming a substantially horizontal position. The user pushes the portable frame forward, causing the left and right contacting members to press against the left and right upper leg portions respectively. The pushing of the frame forward is enabled by the user grasping first and second handles coupled to the frame with his/her hands and urging the handles and thus the frame forward.

The handles are positioned to be angled upwardly from a plane through major portions of the device by about 50 degrees and are oriented about 25 degrees from a baseline towards the contacting members so that pushing on both handles in a forward direction is ergonomically comfortable for the wrist.

Increased unilateral traction ability is produced by simply having the user selectively apply extra force to one handle or the other. This will permit users suffering from unilateral pain in the buttocks, hip or leg to obtain a little extra pressure on the symptomatic side. Anyone who has suffered low back pain can relate to the fact that some days the pain feels more right sided and some days more left sided.

BRIEF DESCRIPTION OF THE DRAWINGS

Other aspects of the invention will become more apparent upon study of the following description taken in conjunction with the drawings in which.

DETAILED DESCRIPTION OF PREFERRED EMBODIMENTS OF THE INVENTION

Figure 1:
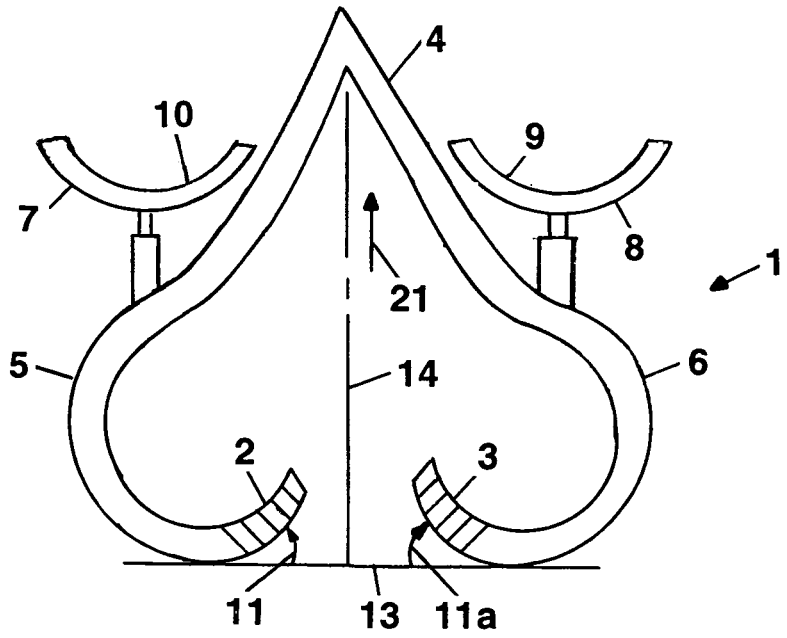
FIG. 1 shows a top view of the device used in accordance with the method of the invention.
Figure 2:
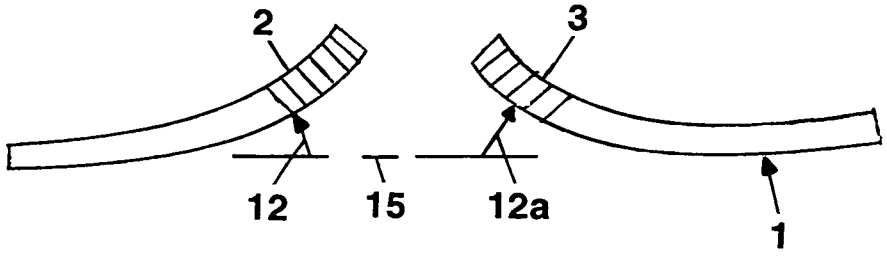
FIG. 2 shows a front view of the portion of the device.

A lightweight, portable, lumbar spinal horizontally oriented distraction device, shown in the top view of FIG. 1 and in part in the front view of FIG. 2, which employs a frame 1 having concave left and right hand upper leg contacting members 7 and 8 for asserting forces against substantially vertically oriented left and right upper leg portions of a user lying on his back assuming a substantially horizontal position. The user pushes the portable frame 1 forward in the direction of arrow 21, causing the left and right contacting members to press against his left and right upper leg portions respectively. The pushing of the frame forward is enabled by the user grasping first and second handles 2 and 3 coupled to the frame with his/her first and second hands and urging the handles and thus the frame forward.

The handles are positioned to be angled upwardly from the horizontal plane 15 of the horizontally oriented device by about 50 degrees; see angles 12 and 12A in FIG. 2 and are oriented about 25 degrees from a baseline 13; see angles 11 and 11A in FIG. 1, in a direction toward the contacting members 7 and 8, so that pushing on both handles in a forward direction is ergonomically comfortable for the wrist. Baseline 13 is perpendicular to the longitudinal axis 14 of the device. This action produces lumbar spine traction under instantaneous full control of the user.

Additionally, increased unilateral traction ability is produced by simply having the user selectively apply extra forward force to one handle or the other. This will enable users suffering from unilateral pain in the buttocks, hip or leg to assert a little extra pressure on the symptomatic side. Anyone who has suffered low back pain can relate to the fact that on some days the pain feels more right sided and other days more left sided.

The handles 2 and 3 are coupled to a forward frame portion 4 configured to be positioned between the vertically oriented legs of a user assuming a horizontal position via frame portions 5 and 6. Padding layers 9 and 10 for comfort are positioned upon the concave contacting members as shown in FIG. 1. The frame is preferably made of hollow metallic tubing that lies in the same plane except for the handles.

Unlike all previous lumbar spine traction methods to date known to me, the distraction device of the present invention can offer unilateral increased distraction force controlled by the patient or user, simply by adding more pressure to one handle or the other. This is highly beneficial because almost all disc bulges or herniations occur posterolaterally causing compression of the exiting spinal nerve on the same side. Equal axial distraction is desired but the body is programmed to resist movement on the symptomatic side secondary to protective muscle guarding. A little extra force applied slowly and smoothly to the symptomatic side helps to overcome this resistance after the initial tissue slack is taken out from the bilateral and equal force applied to the handles. Other lumbar spine traction devices known to me require the user to be tied into them or inverted in some way, and "extra" unilateral force is not believed to be possible.

My aforesaid handle design will again allow for maximum amount of force to be applied without putting the wrist in a compromised position. Optional handle padding makes the device more comfortable but will also function to avoid slippage of the hands from sweat. As stated above, the orientations of the handles is designed to angle up approximately 50 degrees upwardly from the horizontal plane and a second angle of approximately 25 degrees towards the concave contacting members. This will allow the caudal force to be translated through the hypothenar/pisiform area of the wrist causing a relaxed grip and freeing up the digits of the hand, thus avoiding grip fatigue.

The design of the distraction device of the present invention is unlike any other home distraction device known to the inventor, who is a chiropractor, for the lumbar area. Firstly, it does not require the patient or user to be tied into it, or clamped around your ankles. It employs a new approach to lumbar spine distraction by utilizing the upper anterior thighs as short levers and ones upper extremities as the distractive force. Devices such as inversion tables or the Lynx home traction unit utilize a long lever approach that clamps around ones ankles and although the clamps are padded, ankle discomfort is almost unavoidable. This should be apparent to those persons who understand joint structure and biomechanics.

By utilizing the ankles as ones focal point for distraction of the lumbar spine, in accordance with the prior art, one has to generate forces large enough to overcome the joint play, in three major joints (ankles, knees, hips) bilaterally, before joints in the region of the lumbar spine. Once you overcome the joint play in these three major joints of the body you have to apply more force to separate the lumbar spine which can be accomplished. However, you are now stressing all of those joints maximally to achieve this. This is not comfortable for any of those joints, not to mention that if you have damage or injuries within any of those joints, traction may be contraindicated.

Another thing to consider, by having your legs extended in this posture, you maintain the lumbar lordosis and this offers resistance to axial stretching by maintaining a 30-40 pound axial compressive force on the lumbar spine. Products utilizing this long lever design maintain the lumbar lordosis and therefore have to overcome this existing compressive force before lumbar distraction will occur and subsequently more distractive force is required. The inversion tables offer more force and can overcome these complications more easily, however, the amount of applied force is tough to control on an inversion table and it's difficult tough to avoid applying too much force.

Other marketed devices known to me require a large effort on ones upper extremities to overcome all these resistant forces and would cause a large number of potential users in the market to quit before realizing the benefits of traction, and secondarily may cause shoulder or trapezius fatigue and tension.

The distraction device of the present invention is designed to be portable. A prototype measures approximately 12" by 18" and should weigh approximately 3 pounds. One can put it in a car for long trips; the user can take it to games or work events. It does not require electricity to operate or doors to function. Anywhere the user can lie on his back he or she can operate the device.

A revolutionary design feature I have not yet seen provided by any other home traction device is the increased unilateral traction ability by simply adding extra force to one handle or the other. This will permit patients suffering from unilateral pain in the buttocks, hip or leg to obtain a "little extra" pressure on the symptomatic side. Anyone who has suffered low back pain can relate to the fact that some days it feels more right sided and some days more left sided. This feature is appealing and can be easily accomplished because of the distraction devices unique design.

The distraction device of my invention requires no ankle clamps, hook and loop fasteners or being tied down to or attached to anything. The device is designed to self-direct a controlled force and target it at structures that are in optimum position to attain lumbar spine distraction without having to fight large compressive forces. A user is in total control each and every time it is used. Some days the user may be able to tolerate 50 pounds of force, some days only 25. Either way; if he is feeling discomfort at anytime, he simply lets go from pushing on the handles and the applied force is halted. There should not be any rebound spasm because the user starts off slow and controlled; if he can't tolerate the pain, he need not progress further as he should never overstretch.

The distraction device is designed to be lightweight yet strong enough to tolerate compressive forces of at least 150 pounds. I feel that metal is the preferred medium for the frame, whether it be stainless steel, aluminum or some other lightweight but strong substance, metal tubing is preferred. I envision the distraction device painted with a high sheen gray textured coating and black padding located on the hand grips and leg contacts. This padding would not be thick and resilient because that would create more undesirable resistance to the manually applied force, but should be rather like the tight compressed padding on the handles of most commercial and home gym equipment. In the future, a women's or men's model can be produced in pink, purple, gray or blue. Future models can offer adjustable leg contacts and hand grips to make it more appealing to the larger people in our market.

Figure 3:
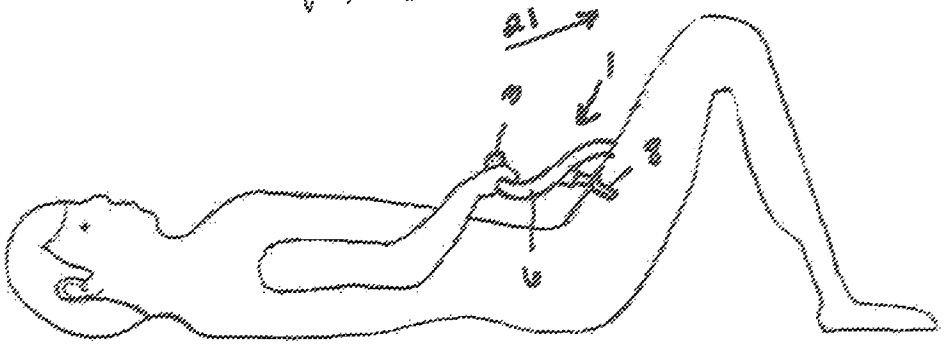
FIG. 3 shows a side view of the user applying a force to the device while being in a substantially horizontal position.

In summary, the presently most preferred method for effecting lumbar spinal distraction in accordance with the invention (as shown in FIG. 3) includes:

(a) providing a user with a spinal distraction device, for effecting lumbar spinal distraction, that has a frame 1 having a pair of handles 2 and 3 and concave left and right hand upper leg contacting members 7 and 8 for asserting distraction forces against substantially vertically oriented left and right upper leg portions respectively of a user, when the user lies on his back;

(b) having the user lie on his back while manually grasping the handles and (c) pushing forward on the handles for producing forces asserted against substantially vertically oriented upper leg portions by the left hand and right hand contacting members, such forces being sufficient to produce lumbar spinal distraction; and (d) instructing the user to selectively apply extra force to one handle or the other, thereby to provide unilateral increased distraction force controlled by the user.

While the invention has been described in connection with preferred embodiments, the description is not intended to limit the scope of the invention to the particular forms set forth, but on the contrary, it is intended to cover such alternatives, modifications, and equivalents as may be included within the spirit and scope of the invention as indicated by the language of the appended claims.

For example, the handles could conceivably be replaced by a cross-piece bridging the gap between the handles that could be manually grasped. While generally the plane 15 through major portions of the frame will be horizontally oriented while the user lies on his back in a horizontal position, the plane could conceivably be at an angle with respect to the horizon so that the user also lies under the frame at an angle with respect to the horizon.

What is claimed is:

1. A method for effecting lumbar spinal distraction, comprising:

a user using a spinal distraction device having no moving parts, for effecting lumbar spinal distraction, and having a pair of left and right handles coupled to individual left and right upper leg contacting members via a frame for asserting distraction forces against left and right upper leg portions, respectively, of a user;

the user lying in a substantially horizontal position on the user's back with the left and right upper leg portions being substantially vertically oriented; and maintaining the substantially horizontal position with the left and right upper leg portions being substantially vertically oriented while grasping said handles and while pushing forward on said left and right handles for producing forces asserted against said upper leg portions by said left and right upper leg contacting members, until said forces are sufficient to produce lumbar spinal distraction and lumbar spine traction under full control of the user.

2. A method for effecting lumbar spinal distraction, comprising:

a user using a portable spinal distraction device having no moving parts, for effecting lumbar spinal distraction, the spinal distraction device being strong enough to tolerate forces of about 150 pounds and having a pair of left and right handles coupled to individual left and right upper leg contacting members via a frame for asserting distraction forces against left and right upper leg portions, respectively, of a user; said spinal distraction device having no device involving the use of weights or for enabling the user to be tied into the spinal distraction device or inverted with respect to the distraction device;

the user lying in a substantially horizontal position on the user's back with the left and right upper leg portions being substantially vertically oriented; and maintaining the substantially horizontal position with the left and right upper leg portions being substantially vertically oriented while grasping said handles and while pushing forward on said pair of left and right handles for producing forces asserted against said upper leg portions by said left and right upper leg contacting members via the frame, until said forces are sufficient to produce lumbar spinal distraction and lumbar spine traction under full control of the user.

3. The method of claim 2 wherein the user selectively applies extra force to one handle or another handle for providing unilateral increased distraction force controlled by the user.

* * * * *